US011346547B2

(12) United States Patent
Karmous

(10) Patent No.: US 11,346,547 B2
(45) Date of Patent: May 31, 2022

(54) CANDLE SUPPORT AND LIGHTING SYSTEM

(71) Applicant: Kareem Shaker Karmous, Raleigh, NC (US)

(72) Inventor: Kareem Shaker Karmous, Raleigh, NC (US)

( * ) Notice: Subject to any disclaimer, the term of this patent is extended or adjusted under 35 U.S.C. 154(b) by 10 days.

(21) Appl. No.: 16/565,610

(22) Filed: Sep. 10, 2019

(65) Prior Publication Data

US 2021/0071862 A1 Mar. 11, 2021

(51) Int. Cl.

| | |
|---|---|
| ***F23D 3/16*** | (2006.01) |
| ***F21V 35/00*** | (2006.01) |
| ***F23Q 13/00*** | (2006.01) |
| ***F23D 3/18*** | (2006.01) |
| ***F21W 121/00*** | (2006.01) |

(52) U.S. Cl.

CPC ..... *F23D 3/16* (2013.01); *F21V 35/00* (2013.01); *F23D 3/18* (2013.01); *F23Q 13/00* (2013.01); *F21W 2121/002* (2013.01)

(58) Field of Classification Search

CPC .... F21V 35/003; F21V 35/00; F21V 21/0085; F23D 3/18; F23D 3/16; F23Q 13/00

USPC ..... 431/289, 295, 296

See application file for complete search history.

(56) References Cited

U.S. PATENT DOCUMENTS

| | | | | |
|---|---|---|---|---|
| 89,270 A * | 4/1869 | Anton | A01K 97/10 | 248/512 |
| 151,055 A * | 5/1874 | Reessing | F21V 35/00 | 431/296 |
| 581,725 A * | 5/1897 | Hoffmann | F21V 35/00 | 431/294 |
| 2,159,115 A * | 5/1939 | Vogel, Jr. | F21V 35/00 | 431/296 |
| 5,552,974 A * | 9/1996 | Tsai | F21S 4/10 | 362/123 |
| 6,186,776 B1 * | 2/2001 | Myerchin | F23D 3/16 | 431/287 |

* cited by examiner

*Primary Examiner* — Vivek K Shirsat
(74) *Attorney, Agent, or Firm* — NK Patent Law

(57) ABSTRACT

An assembly for use with a cake is provided. The assembly includes a plurality of candles and a plurality of candle holders. Each individually sized candle holder is configured for receiving one candle of the plurality of candles. A plurality of links are part of the assembly, and a link connects adjacent candle holders. The link is flexible to allow selective placement of each of the candle holders. A wick connector extends between wicks of adjacent candles. Lighting of the wick connector allows for the lit wick connector to extend to all of the plurality of candles to light the candles.

5 Claims, 5 Drawing Sheets

CANDLE SUPPORT AND LIGHTING SYSTEM

TECHNICAL FIELD

The present disclosure relates to a candle support and lighting system for quickly lighting a series of candles while maintaining positioning of the candles.

BACKGROUND

The present invention relates to a candle support and lighting system, and more specifically to a lighting system using an intermediate member between the fuse and wick.

Birthday cakes with candles representing the number of years of the birthday person are an age-old tradition. Lighting all of the candles before presenting the cake to the birthday person is part of this tradition. Where there are more than just a few candles, it is difficult to light all the candles sufficiently rapidly to avoid substantial melting of the candles and getting wax on the cake. In addition, the task of lighting the candles itself is tedious and runs the risk of burning the lighter's hand.

Furthermore, the spacing for a plurality of candles is such that while lighting one candle, an adjacent candle may be moved out of the way, impacting the spacing of the candles.

What is needed is a fast-burning fuse with a quick and simple mechanism to attach to standard candle wicks which ensures lighting of each of the wicks.

SUMMARY

This summary is provided to briefly introduce concepts that are further described in the following detailed descriptions. This summary is not intended to identify key features or essential features of the claimed subject matter, nor is it to be construed as limiting the scope of the claimed subject matter.

According to one or more embodiments, an assembly includes a plurality of candles and a plurality of candle holders, each individually sized for receiving one candle of the plurality of candles. A plurality of links connect adjacent candle holders. The link is flexible to allow selective placement of each of the candle holders. A wick connector extends between wicks of adjacent candles. Lighting of the wick connector allows for the lit wick connector to extend to all of the plurality of candles to light the candles.

According to one or more embodiments, each of the link defines a joint at a medial portion thereof so that a combined length of the plurality of links can be adjusted by addition or removal of additional candle holders.

According to one or more embodiments, a loop can be formed by engaging a joint of a first candle holder with a joint of a last candle holder.

According to one or more embodiments, the joint defines a vertically extending pin of a first portion of the link and a corresponding shoulder on a second portion of the link, the pin and shoulder being engagable together.

According to one or more embodiments, each of the candle holders defines a spike on a bottom thereof for being inserted into a cake.

According to one or more embodiments, the wick connector is a fast burning material.

BRIEF DESCRIPTION OF THE DRAWINGS

The previous summary and the following detailed descriptions are to be read in view of the drawings, which illustrate particular exemplary embodiments and features as briefly described below. The summary and detailed descriptions, however, are not limited to only those embodiments and features explicitly illustrated.

DETAILED DESCRIPTIONS

Figure 1:
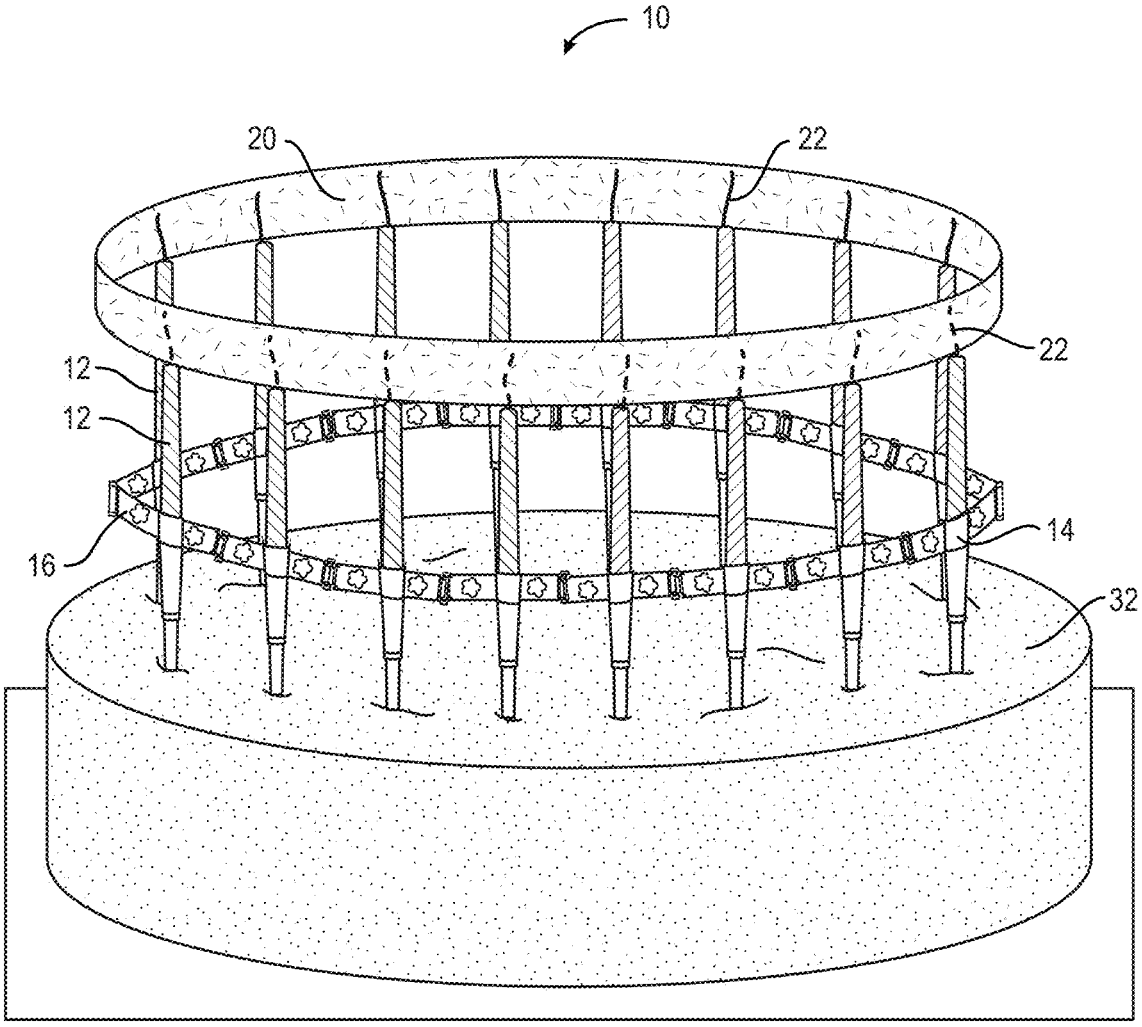
FIG. 1 illustrates a perspective view of a candle and holder assembly according to one or more embodiments disclosed herein.
Figure 2:
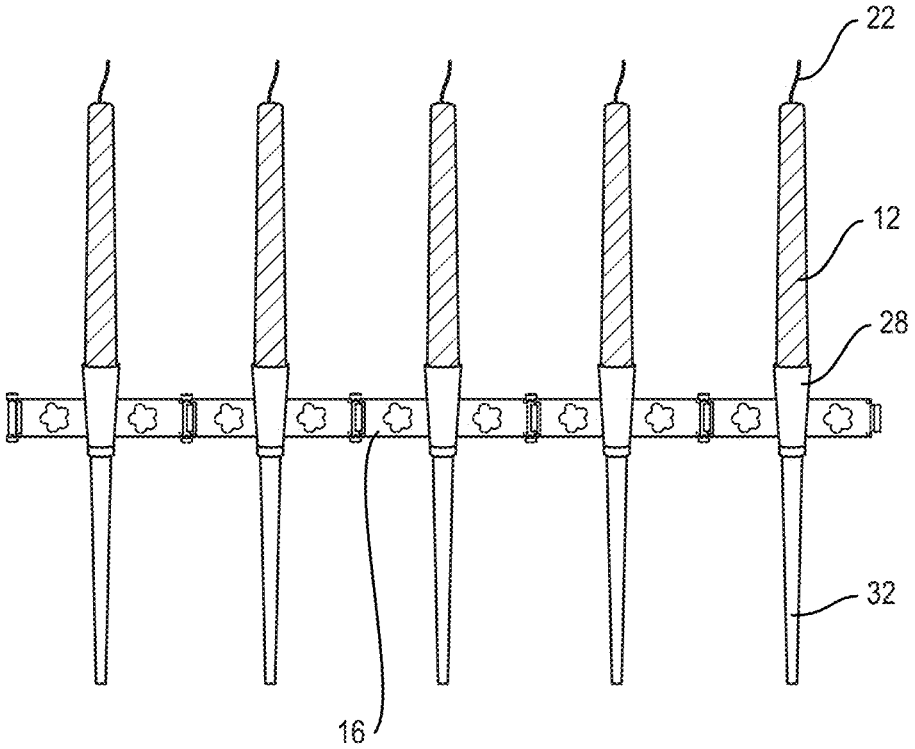
FIG. 2 illustrates a side view of a candle and holder assembly according to one or more embodiments disclosed herein.
Figure 3:
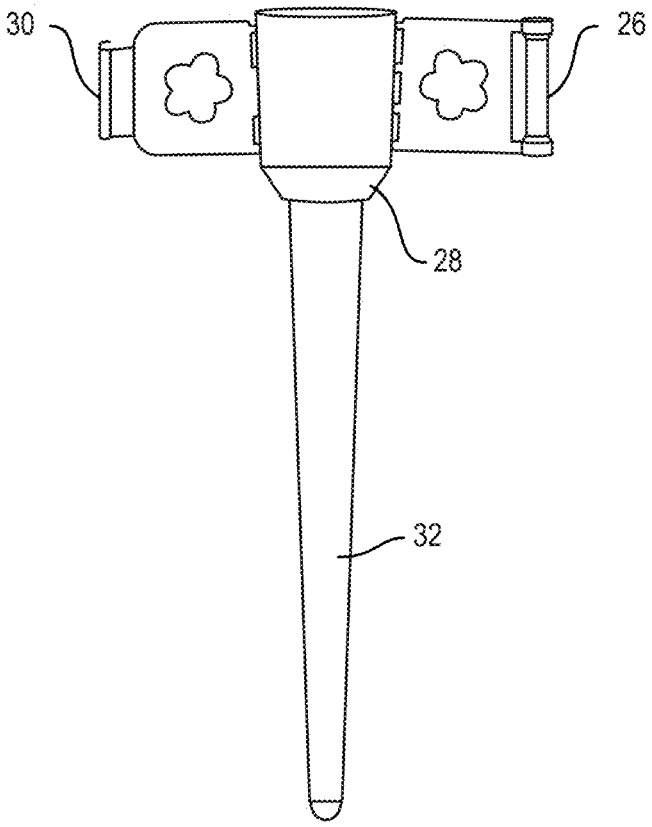
FIG. 3 illustrates a candle holder according to one or more embodiments disclosed herein.
Figure 4:
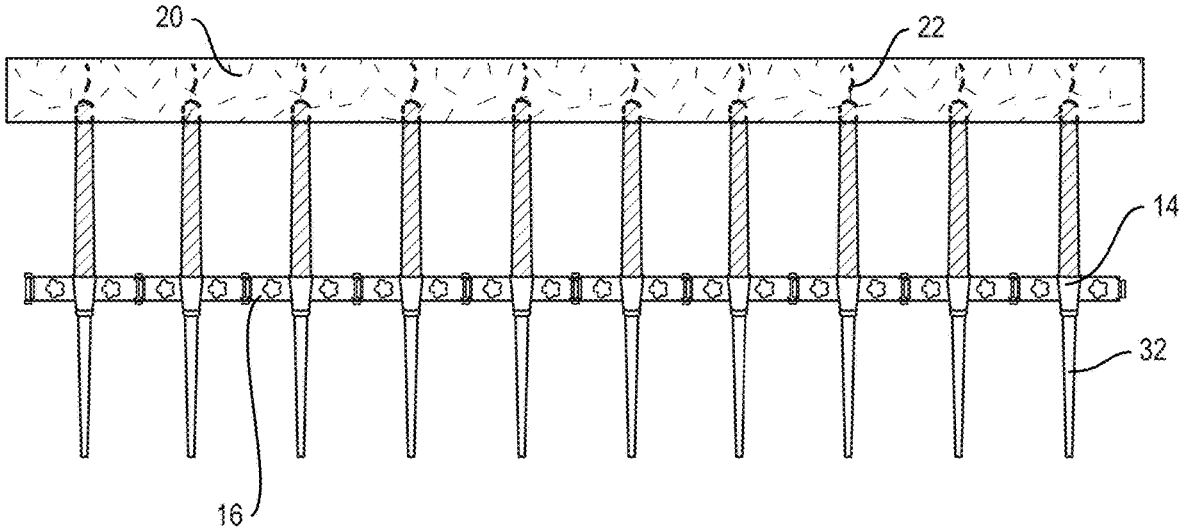
FIG. 4 illustrates an array or assembly of candle holders and candles according to one or more embodiments disclosed herein.
Figure 5A:
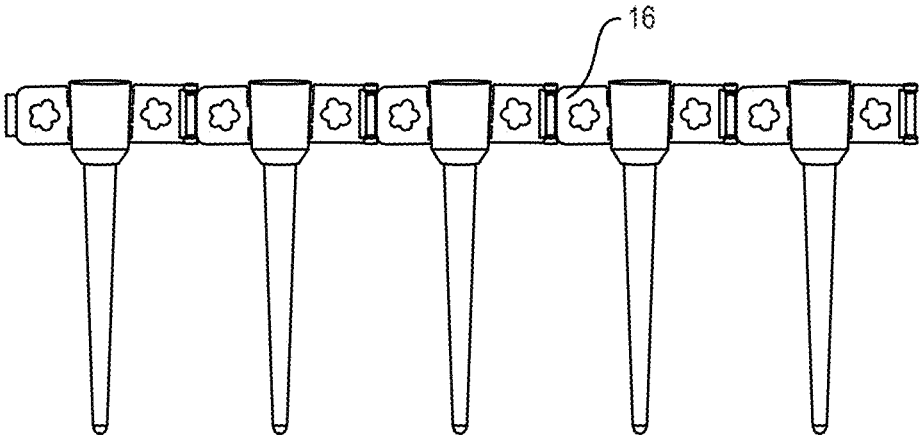
FIGS. 5A and 5B illustrate an array of candle holders in respective first and second positions.
Figure 5B:
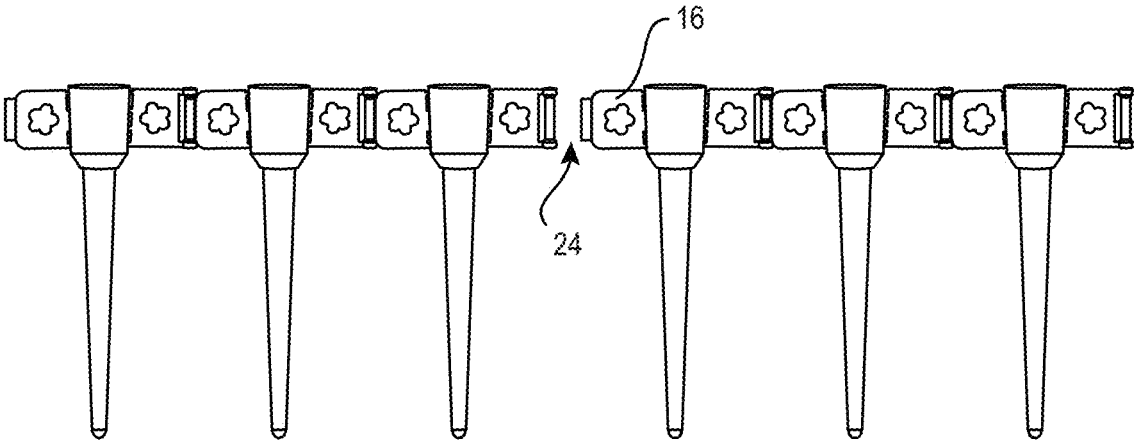

These descriptions are present particular embodiments with sufficient details to provide an understanding of broader inventive subject matters. These descriptions expound upon and exemplify particular features of those particular embodiments without limiting the inventive subject matters to the explicitly described embodiments and features. Considerations in view of these descriptions will likely give rise to additional and similar embodiments and features without departing from the scope of the inventive subject matters.

Any dimensions expressed or implied in the drawings and these descriptions are provided for exemplary purposes. Thus, not all embodiments within the scope of the drawings and these descriptions are made according to such exemplary dimensions. The drawings are not made necessarily to scale. Thus, not all embodiments within the scope of the drawings and these descriptions are made according to the apparent scale of the drawings with regard to relative dimensions in the drawings. However, for each drawing, at least one embodiment is made according to the apparent relative scale of the drawing.

Unless described or implied as exclusive alternatives, features throughout the drawings and descriptions should be taken as cumulative, such that features expressly associated with some particular embodiments can be combined with other embodiments.

The drawings illustrate various embodiments of an assembly 10 for a cake 1. The assembly 10 includes a plurality of candles 12. The candles 12 may be sized the same as each other, of differing sizes, or may take on any appropriate configuration. The candles 12 each have a wick 22 extending from a wax or other main body 28 of the candle 12. A plurality of candle holders 14 are provided Each candle holder 14 may be configured as illustrated and may be each individually sized for receiving one candle 12 of the plurality of candles 12. A plurality of links 16 may connect adjacent candle holders 14. The link 16 is flexible to allow selective placement of each of the candle holders 14. In this manner, the links 16 may be bent, selectively positioned to change an angle of direction between adjacent candles, or even climb in elevation on a cake that has a stepped up orientation. A wick connector 20 extends between wicks 22 of adjacent candles 12. Lighting of the wick connector 20 allows for the lit wick connector 22 to extend to all of the plurality of candles 12 to light the candles, meaning, that once any portion of the wick connector 20 is lit, the lit fire spot will extend to the remaining portions of the wick connector 20. The wick connector 20 may be a fast burning connector, and may employ other advantageous aspect such as a color burning flame to provide a further visually pleasing aspect to the lit candle assembly 12.

Each of the links 16 defines a joint 24 at a medial portion thereof so that a combined length of the plurality of links 16 can be adjusted by addition or removal of additional candle holders 14. A loop can be formed by engaging a joint 24 of a first candle holder 14 with a joint 24 of a last candle holder 14. In one or more embodiments, the joint 24 defines a vertically extending pin 26 of a first portion of the link 16 and a corresponding shoulder 30 on a second portion of the link 16. The pin 26 and shoulder 30 are configured for being engagable together. Advantageously, any other arrangement may be employed, including an arrangement where the link 16 is just a flexible material. The link 16 extends from a base 28 that may additionally have component similar to the shoulder/pin arrangement. As illustrated, each of the candle holders 14 may define a spike 32 on a bottom thereof for being inserted into a cake 1. The spike 32 may further include a flat portion for resting on a top portion of the cake 1, or any other appropriate configuration.

The pin/shoulder arrangement also allows for a desired length of a number of candles 12 to be employed, whereas, other systems that may include a continuous strand of materials that have to be cut to length may involve a large amount of waste material. Additionally, the pin/shoulder arrangement allows for a user to substitute candle holders of different sizes, colors, and configurations in any desired order.

Particular embodiments and features have been described with reference to the drawings. It is to be understood that these descriptions are not limited to any single embodiment or any particular set of features, and that similar embodiments and features may arise or modifications and additions may be made without departing from the scope of these descriptions and the spirit of the appended claims.

What is claimed is:

1. An assembly comprising:

a plurality of candles, each candle comprising a main body having a lower end and an upper end opposite the lower end, and a wick extending from the upper end;

a plurality of candle holders, each individually sized for receiving a lower end of any one candle of the plurality of candles, each candle holder having a spike extending from a bottom thereof for being inserted into a cake;

a plurality of links, each link connecting adjacent candle holders such that the lower ends of the plurality of candles are connected to each other by the plurality of candle holders and plurality of links, wherein the link is flexible to allow selective placement of each of the candle holders;

a wick connector extending between and connecting wicks of adjacent candles such that the upper ends of the plurality of candles are connected to each other by the wicks and wick connector, wherein lighting of the wick connector allows for the lit wick connector to extend to all of the plurality of candles to light the candles, wherein the wick connector is a band extending between wicks of adjacent candles and to the upper end of adjacent candles to provide support thereto.

2. The assembly according to claim 1, wherein each of the link defines a joint at a medial portion thereof so that a combined length of the plurality of links can be adjusted by addition or removal of additional candle holders.

3. The assembly according to claim 2, wherein a loop can be formed by engaging a joint of a first candle holder with a joint of a last candle holder.

4. The assembly according to claim 3, wherein the joint defines a vertically extending pin of a first portion of the link and a corresponding shoulder on a second portion of the link, the pin and shoulder being engagable together.

5. The assembly according to claim 1, wherein once any portion of the wick connector is lit, a lit fire spot will extend to remaining portions of the wick connector.

* * * * *